United States Patent [19]

Wycklendt et al.

[11] 4,109,228

[45] Aug. 22, 1978

[54] CURRENT LIMITING FUSE WITH RESINOUS ARC-QUENCHING FILLER

[75] Inventors: Daniel A. Wycklendt, Milwaukee; Martin Hudis, Wauwatosa, both of Wis.

[73] Assignee: Electric Power Research Institute, Inc., Pala Alto, Calif.

[21] Appl. No.: 788,241

[22] Filed: Apr. 18, 1977

[51] Int. Cl.[2] ..... H01H 85/18

[52] U.S. Cl. ..... 337/276; 337/279; 337/280

[58] Field of Search ..... 337/228, 229, 276, 277, 337/273, 279, 280

[56] References Cited

U.S. PATENT DOCUMENTS

| | | | |
|---|---|---|---|
| 3,275,771 | 9/1966 | Salzer | 337/279 X |
| 3,291,942 | 12/1966 | Kozacka | 337/276 X |
| 4,032,879 | 6/1977 | Monagan | 337/278 |

FOREIGN PATENT DOCUMENTS

| | | | |
|---|---|---|---|
| 577,805 | 5/1946 | United Kingdom | 337/276 |

*Primary Examiner*—George Harris

*Attorney, Agent, or Firm*—Flehr, Hohbach, Test, Albritton & Herbert

[57] ABSTRACT

A current limiting fuse construction including a fuse element extending between electroconductive terminals carries a body of arc-quenching filler material within a hollow casing of electric insulating material. The filler material includes loose granular insulating material, such as sand, and larger particles of material uniformly distributed throughout the sand as a resin vaporizable in response to the heat of an arc current. According to a second embodiment a stratified filler comprises uniformly spaced layers alternately occurring between sand and a sand/resin mixture to increase arc voltage.

5 Claims, 3 Drawing Figures

CURRENT LIMITING FUSE WITH RESINOUS ARC-QUENCHING FILLER

BACKGROUND OF THE INVENTION

This invention pertains to current limiting fuses and more particularly to such a fuse primarily useful as a protection against excessive fault currents.

Fuses of the kind described can be used to protect various devices such as transformers and the like so as to limit the amount of current that will flow to the transformer when a fault occurs. A distribution line, for example, of the type which is used in the region of a residence, can have a potential of generating 10,000 or possibly 20,000 amps. of fault current if grounded. In such event if the fault is inside a distribution transformer, for instance, it would tend to cause the transformer to explode. Further, by locating a current limiting fuse ahead of the transformer, the fuse serves to reduce the fault current to a manageable level, such as on the order of 5,000 amps.

In fuses of this kind, as a rule, the current flows through the conducting element and melts it in a very few milliseconds. This, however, leaves a path of melted material, such as silver, so that the current can still follow a path through the molten metal through the fuse. In this way it continues to heat the metal until it vaporizes. After the metal has been vaporized it can still support a flow of current, but now the current is in the form of an arc rather than flowing through a conductor. Thus an arc occurs in the sand or other filler material of the fuse, where the molten metal used to be.

An increase in heat removal from the arc will lead to a higher voltage required to maintain the arc, thereby decreasing both the time required to drive the current to zero and the amount of let-through energy.

Use of polymer resin particles in sand as a filler is known for ablation of gas to cool the arc. However, as disclosed herein it has been found that for large arc voltage the resin must be considerably larger than the sand. Thus, the addition of large resin particles (relative to the sand particle size) to a sand filler increases both the average arc gradient and the interruption ability of the fuse.

SUMMARY AND OBJECTS OF THE INVENTION

In general, there has been provided a current limiting fuse construction having a hollow casing of electric insulating material. Electroconductive terminal elements are disposed to close the ends of the casing to retain a body of arc-quenching filler material inside the casing. A fuse element extends electrically between the terminal elements for passing current therebetween via the fuse element. The body of arc-quenching filler includes loose granular insulating material and relatively large heat responsive resinous particles distributed sustantially uniformally throughout the body of granular material to increase the average arc gradient. These particles are of a material which is vaporizable in response to heat to provide gas flow for cooling an arc defined between ruptured portions of the fuse. The particles do not substantially carbonize when vaporized. Hence, they remain substantially free of carbon after being vaporized to preclude further conduction after vaporizing.

According to a second embodiment, the vaporized gas is evenly and substantially uniformly created by a stratified filler comprising spaced layers alternating between sand and a sand/resin mixture to increase the arc voltage.

In general, it is an object of the present invention to provide an improved current limiting fuse having improved arc-quenching and arc voltage characteristics.

It is a further object of the present invention to provide a current limiting fuse of the kind described in which vaporizable particles are carried and supported by a body of insulating filler material in a manner to evenly and substantially uniformly vaporize in response to heat derived from arc current in the fuse element.

A further object of the present invention is to provide a current limiting fuse which is simple and inexpensive to make while yet providing a uniformly vaporizing of the gas generating material.

The foregoing and other objects of the invention will become more readily evident from the following detailed description of preferred embodiments.

DETAILED DESCRIPTION OF PREFERRED EMBODIMENTS

Figure 1:
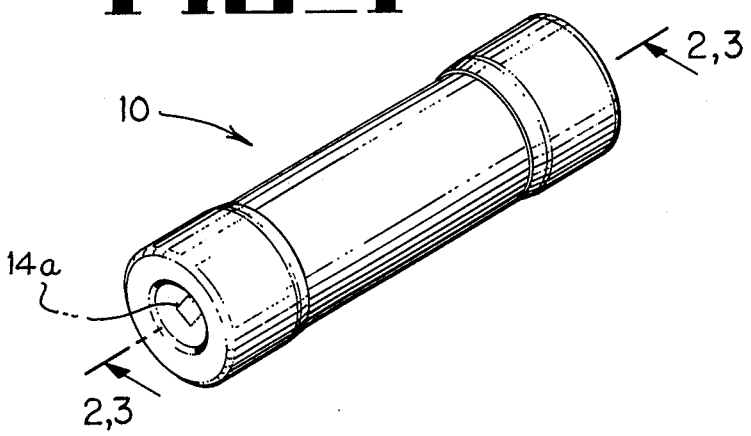
FIG. 1 shows a diagrammatic perspective view of the exterior of a fuse according to each of two embodiments of the invention.

The current limiting fuse 10 comprises an elongate hollow casing 11 of electric insulating material in generally a cylindrical configuration (as shown). Each end of casing 11 carries electroconductive terminal elements 12, 13. An elongate fuse element 14 extends electrically between elements 12, 13.

Each end of fuse element 14 is secured to an associate terminal by means of a deposit 16 of solder after the end of element 14 has been passed through a slot and bent transversely to its length to form a pad as shown best at 14*a*.

A body of arc-quenching filler material 17 within casing 11 comprises loose granular insulating material such as sand 18 formed primarily of silica uniformly mixed with relatively large particles of vaporizable material, such as resin, carried and supported by the body of insulating material 18.

Preferably, the vaporizable material 19 is in the form of particles on the order of 1 to 2 millimeters of a resin, preferably such as acetal, polypropylene, etc. having the characteristics of a large melting temperature large density and a decomposable source of gas during the arcing of the fuse element to increase average arc gradient.

Fuse element 14 includes a series of holes 21 formed therealong for purposes for providing small hot spots. The hot spots melt first and the arc commences at that location. Then the arc grows at each end of the more solid parts of the element.

In operation, it has been observed that when fuse 10 is subjected to a fault current or overload current, fuse element 14 melts but temporarily provides a molten path of metal through the sand for the current to flow. The melted material continues to heat until it vaporizes.

After it has vaporized, current can still flow but now only by means of the arc thereby created between the two ruptured ends of element 14. It has been observed that by providing vaporizable resin particles uniformly distributed within the sand, the heat removal rate will be increased which will lead to an increase in arc voltage with consequent improvement in interruption.

Figure 2:
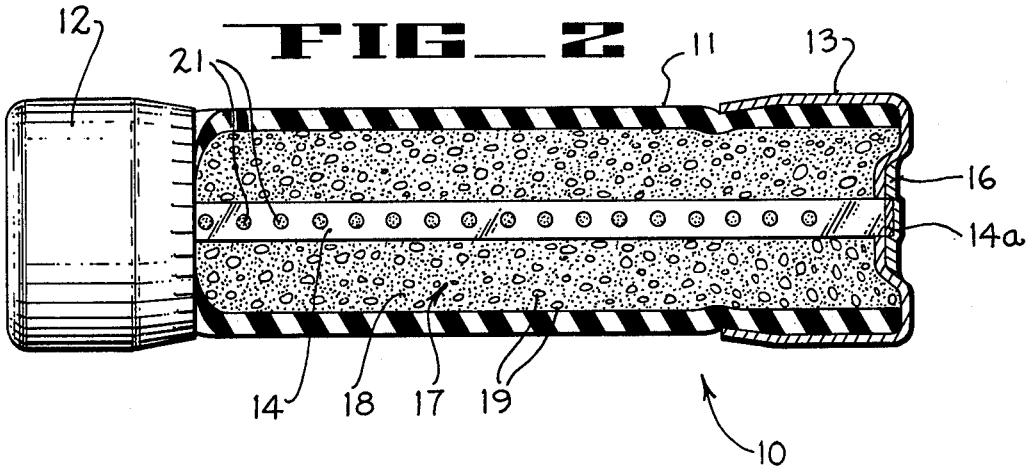
FIG. 2 shows a diagrammatic side elevation view of FIG. 1 with a substantial portion thereof broken away for clarity along the line 2—2 thereof.
Figure 3:
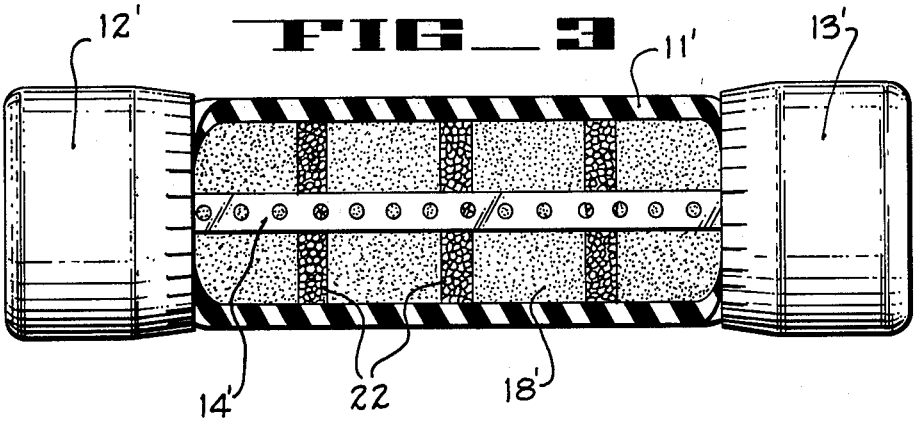
FIG. 3 along a diagrammatic side elevation view of FIG. 1 according to a second embodiment with a central portion thereof broken away for clarity along the line 3—3 of FIG. 1.

According to a second embodiment, as shown in FIG. 3, a fuse is provided with a hollow casing 11' similar to the casing 11 in FIG. 2 and electroconductive terminal elements 12', 13' as shown in FIG. 2 at 12, 13. A fuse element 14' comparable to fuse element 14 is also employed and for the same reasons.

In FIG. 3, however, the means for evenly and substantially uniformly vaporizing an additive comprises a plurality of relatively thin layers 22 of a sand/resinous mixture.

By employing the relatively thin layers 22 of a vaporizable resin/sand mixture at spaced intervals (preferably uniform) along the length of the fuse it is possible to mechanically provide an even and substantially uniform vaporization of the resin to quickly cool the arc, while maintaining a desirable arc channel of small cross section over the major portion of the arc path.

From the foregoing it will be readily evident that there has been provided in each of the two embodiments an improved current limiting fuse construction in which a vaporizing additive is disposed in a body of filler material such as sand in a manner serving to increase the arc voltage of the fuse and thereby improve the cut-off capability thereof by insuring even and substantially uniform vaporizing.

We claim:

1. A current limiting fuse construction comprising a hollow casing of electric insulating material, electroconductive terminal elements carried by said casing and an elongate fuse element disposed electrically between said terminal elements for passing current therebetween, arc-quenching filler material within said casing, said filler material comprising a body of loose granular insulating material submerging the fuse element therein, substantially larger heat responsive gasevolving polymer resin particles relative to said granular material distributed substantially uniformly throughout said insulating material to increase the average arc gradient, said particles being vaporizable in response to heat for cooling an arc defined between ruptured portions of the fuse element while remaining substantially free of carbon after being so vaporized to preclude further conduction after vaporization thereof.

2. A fuse according to claim 1 in which said particles comprise a resin material.

3. A current limiting fuse construction comprising a hollow casing of electric insulating material, electroconductive terminal elements carried by said casing and an elongate fuse element disposed electrically between said terminal elements for passing current therebetween, arc-quenching filler material within the casing, said filler material comprising a body of loose granular insulating material submerging the fuse element therein, and relatively larger particles of vaporizable material for decreasing the bulk void content relative to pure sand, said vaporizable material being carried and supported by said body of insulating material in a manner serving to evenly and substantially uniformly vaporize in response to heat from the application of arc current to said fuse element.

4. A current limiting fuse according to claim 3 including a stratified filler comprising a plurality of uniformly spaced discrete layers of said vaporizable resin in a mixture with sand, said layers being disposed transversly of the axis of said element at spaced intervals therealong alternating between sand and a sand/resin mixture to increase the arc voltage.

5. In a current limiting fuse having a hollow casing of electric insulating material, electroconductive terminal elements carried by the casing and a fuse element disposed electrically between said terminal elements for passing current therebetween via said fuse element, a mixture of loose, granular insulating material and relatively larger particles of vaporizable resin material within said casing submerging said fuse element to increase the average arc gradient, said mixture being disposed in heat transfer relation to said fuse element for vaporizing said resin material in response to arc current temperature generated via said fuse element, the vaporizing of said resin serving to cool an arc defined between the ruptured ends of said fuse element to increase the arc voltage level of the fuse.

* * * * *